US007438138B2

(12) United States Patent
Andersson et al.

(10) Patent No.: US 7,438,138 B2
(45) Date of Patent: Oct. 21, 2008

(54) IMPACT ADAPTER FOR TRANSFER OF IMPACTS AND ROTATION FROM AN IMPACT ROCK DRILLING MACHINE TO A DRILL STRING

(75) Inventors: Kurt Andersson, Tyresö (SE); Per Jonsson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 641 days.

(21) Appl. No.: 10/525,933

(22) PCT Filed: Sep. 12, 2003

(86) PCT No.: PCT/SE03/01423

§ 371 (c)(1),
(2), (4) Date: Feb. 25, 2005

(87) PCT Pub. No.: WO2004/029400

PCT Pub. Date: Apr. 8, 2004

(65) Prior Publication Data

US 2005/0236167 A1 Oct. 27, 2005

(30) Foreign Application Priority Data

Sep. 27, 2002 (SE) ..... 0202855

(51) Int. Cl.
*E02D 7/02* (2006.01)

(52) U.S. Cl. ..... 173/48; 173/131; 173/132

(58) Field of Classification Search ..... 173/48, 173/93, 93.5, 131, 132, 122, 201; 279/19.3, 279/143; 408/144; 166/242.6; 175/323
See application file for complete search history.

(56) References Cited

U.S. PATENT DOCUMENTS

| | | | | | |
|---|---|---|---|---|---|
| 3,666,022 | A | * | 5/1972 | Bailey et al. | 173/80 |
| 3,797,584 | A | * | 3/1974 | Bailey et al. | 173/105 |
| 4,002,347 | A | * | 1/1977 | Wanner et al. | 279/19.3 |
| 4,106,573 | A | * | 8/1978 | Bailey | 173/106 |
| D266,521 | S | * | 10/1982 | Gustafsson | D15/138 |
| 5,984,596 | A | * | 11/1999 | Fehrle et al. | 408/226 |
| 6,089,330 | A | * | 7/2000 | Miescher et al. | 173/132 |
| 6,109,620 | A | * | 8/2000 | Roberts et al. | 279/143 |
| 6,810,956 | B1 | * | 11/2004 | Sandstrom | 166/242.6 |
| 6,860,340 | B2 | * | 3/2005 | Rodert | 173/104 |

FOREIGN PATENT DOCUMENTS

| | | |
|---|---|---|
| CA | 1160214 | 10/1984 |
| EP | 0198809 | 10/1986 |
| EP | 1077305 | 2/2001 |

* cited by examiner

*Primary Examiner*—Rinaldi I. Rada
*Assistant Examiner*—Nathaniel Chukwurah
(74) *Attorney, Agent, or Firm*—Mark P. Stone

(57) ABSTRACT

Impact adapter for transfer of impacts and rotation from an impact rock drilling machine to a drill string comprising a first end (5) for connection to a drill string and a second end provided with ridges (7) and interposed grooves (8) for transfer of rotation. The grooves (8) at the end (9) directed away from the first end (5) of the impact adapter (2) are widened in the direction away from the first end (5).

2 Claims, 1 Drawing Sheet

IMPACT ADAPTER FOR TRANSFER OF IMPACTS AND ROTATION FROM AN IMPACT ROCK DRILLING MACHINE TO A DRILL STRING

BACKGROUND OF THE INVENTION

The present invention relates to an impact adapter for transfer of impacts and rotation from an impact rock drilling machine to a drill string.

In previously known impact adapters ridges and grooves at the rear end of the impact adapter are used for transferring torque to a drill string from a driver journalled in the rock drilling machine. Because of manufacturing tolerances one has a certain play between the impact adapter and the driver in order to allow the axial movement caused by the impacts of the rock drilling machine against the impact adapter. This results in the impact adapter coming more or less obliquely in the driver. This oblique position in combination with the relative axial movement between the driver and the impact adapter often gives rise to breakage of one or more of the ridges adjacent the rear end of the impact adapter.

SUMMARY OF THE INVENTION

The present invention, which is defined in the subsequent claims, aims at decreasing the problem with ridge breakage by decreasing the surface pressure between impact adapter and driver. This is achieved by making the grooves between the ridges on the impact adapter wider at the rear end of the impact adapter.

BRIEF DESCRIPTION OF THE DRAWINGS

An embodiment of the invention is described below with reference to the appended drawing in which.

DISCUSSION OF THE BEST MODES FOR CARRYING OUT THE INVENTION

Figure 1:
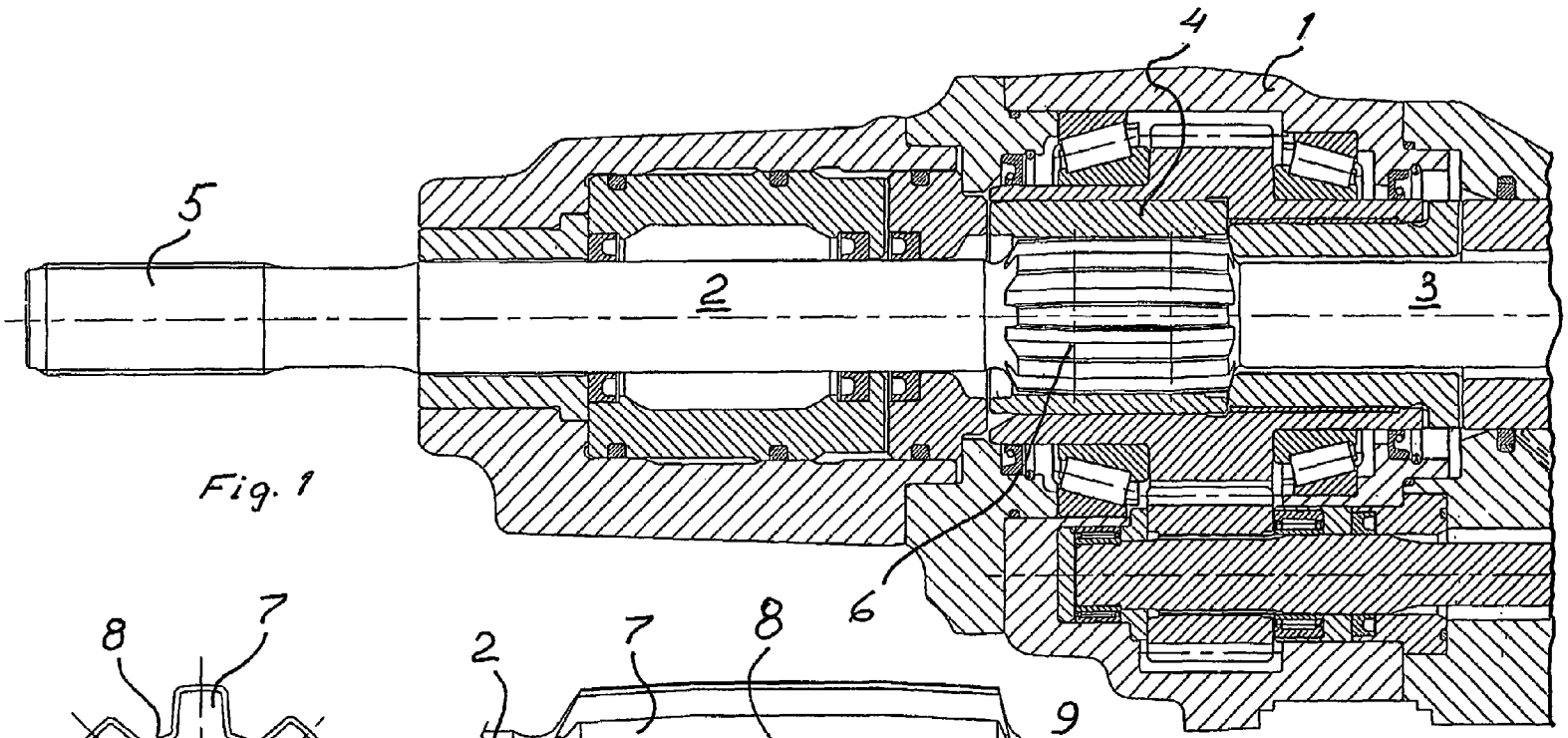
FIG. 1 shows a section through a part of an impact rock drilling machine.
Figure 2:
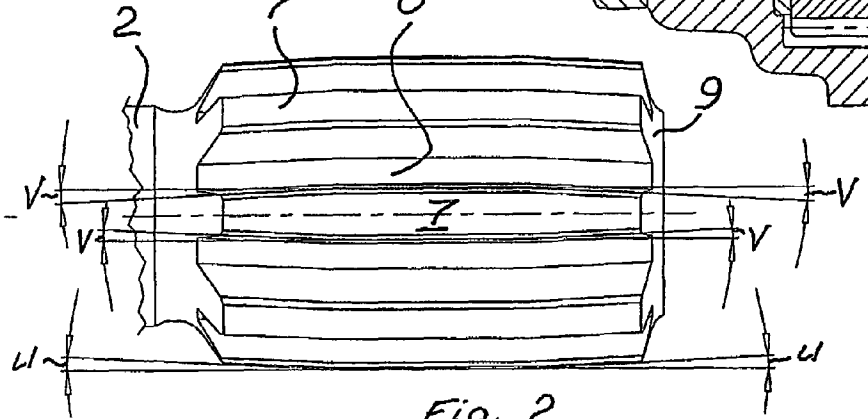
FIG. 2 shows a part of the impact adapter according to the invention.
Figure 3:
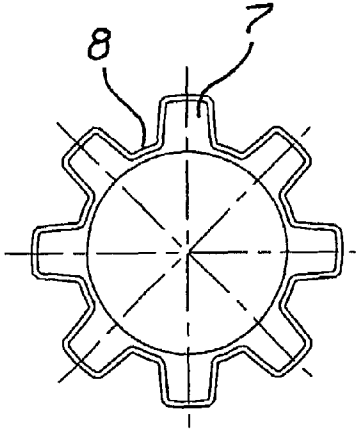
FIG. 3 shows a view from the right in FIG. 2.

The rock drilling machine shown in the drawing comprises a machine housing 1, consisting of several connected parts, in which an impact adapter 2 is displaceably arranged in a driver 4. The driver 4 is rotatable by means of a not shown motor. The driver transfers torque to the impact adapter 2 via splines 6 comprising ridges 7 and interposed grooves 8 at a second end of the impact adapter 2. The impact adapter 2 is at the front end, a first end, provided with a thread 5 for connection to a drill string in the usual way. The grooves 8 are at the end 9 directed away from the first end of the impact adapter widened away from the first end, which is shown by means of the angle ν. Furthermore the ridges 7 have at the rear end 9 a somewhat smaller radial extension, which is shown by means of the angle μ. Through this it is achieved that obliqueness between impact adapter and driver gives a lower surface pressure than what is obtained without these widened grooves. In the drawing the ridges 7 are formed in the same way at the end directed away from the end 9. The grooves widened towards the ends are suitably produced by feeding the milling tool milling the grooves 8 somewhat towards the centre of the impact adapter at the groove ends.

The invention claimed is:

1. Impact adapter for transfer of impacts and rotation from an impact rock drilling machine to a drill string, said impact adapter comprising a first end section for connection to a drill string and a second end section provided with ridges and interposed grooves for transfer of rotation, wherein the grooves at an end of the second end section directed away from the first end section of the impact adapter increase in width in a direction away from the first end section.

2. Impact adapter according to claim 1, wherein the ridges at the end of the second end section directed away from the first end section of the impact adapter decrease in radial extension in a direction away from the first end section.

* * * * *